US010358618B2

(12) United States Patent
Strong et al.

(10) Patent No.: US 10,358,618 B2
(45) **Date of Patent: *Jul. 23, 2019**

(54) LUBRICATING OIL COMPOSITIONS

(71) Applicant: Infineum International Limited, Abingdon (GB)

(72) Inventors: Anthony J. Strong, Oxford (GB); Philip J. Woodward, Reading (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/727,916

(22) Filed: Jun. 2, 2015

(65) Prior Publication Data

US 2015/0344811 A1 Dec. 3, 2015

(30) Foreign Application Priority Data

Jun. 2, 2014 (EP) ..... 14170779

(51) Int. Cl.
*C10M 161/00* (2006.01)

(52) U.S. Cl.
CPC .... *C10M 161/00* (2013.01); *C10M 2201/066* (2013.01); *C10M 2203/1006* (2013.01); *C10M 2209/11* (2013.01); *C10M 2209/111* (2013.01); *C10M 2219/062* (2013.01); *C10M 2219/068* (2013.01); *C10M 2223/045* (2013.01); *C10M 2223/065* (2013.01); *C10N 2210/06* (2013.01); *C10N 2230/06* (2013.01); *C10N 2230/42* (2013.01); *C10N 2230/45* (2013.01); *C10N 2230/54* (2013.01); *C10N 2240/102* (2013.01); *C10N 2240/104* (2013.01)

(58) Field of Classification Search
CPC ..... C10M 2201/066; C10M 2205/022; C10N 2230/02; C10N 2220/02
USPC ..... 508/167, 306, 591
See application file for complete search history.

(56) References Cited

U.S. PATENT DOCUMENTS

2006/0068999 A1* 3/2006 Shaw ..... C10M 163/00 508/287
2013/0035270 A1 2/2013 Thompson et al.

FOREIGN PATENT DOCUMENTS

EP 2650349 A1 10/2013
WO WO 2011107739 A1 * 9/2011 ..... C10M 145/22

* cited by examiner

*Primary Examiner* — Vishal V Vasisth

(57) ABSTRACT

A lubricating oil composition having a sulphated ash content of less than or equal to 1.2 mass % as determined by ASTM D874 and a phosphorous content of less than or equal to 0.12 mass % as determined by ASTM D5185, which lubricating oil composition comprises or is made by admixing: an oil of lubricating viscosity, in a major amount; an oil-soluble or oil-dispersible polymeric friction modifier as an additive in an effective minor amount; and, at least one oil-soluble or oil-dispersible molybdenum compound as an additive in an effective minor amount.

6 Claims, No Drawings

LUBRICATING OIL COMPOSITIONS

FIELD OF THE INVENTION

The present invention relates to automotive lubricating oil compositions which exhibit improved friction characteristics. More specifically, although not exclusively, the present invention relates to automotive crankcase lubricating oil compositions for use in gasoline (spark-ignited) and diesel (compression-ignited) internal combustion engines, such compositions being referred to as crankcase lubricants; and to the use of additives in such lubricating oil compositions for improving the friction characteristics of the lubricating oil compositions and/or improving the fuel economy performance and/or fuel economy retention properties of an engine lubricated with the lubricating oil composition.

BACKGROUND OF THE INVENTION

A crankcase lubricant is an oil used for general lubrication in an internal combustion engine where an oil sump is situated generally below the crankshaft of the engine and to which circulated oil returns. To reduce the energy and fuel consumption requirements of the engine, there is a need for crankcase lubricants that reduce the overall friction of the engine. Reducing friction losses in an engine contributes significantly to improving fuel economy performance and fuel economy retention properties. It has long been known to use friction modifiers to obtain improved friction performance. However, the effect of such friction modifiers may not be fully realised due to preferred adsorption of other additives on moving surfaces.

Oil-soluble molybdenum containing additives may be used for their friction reducing properties. Examples of patent applications which refer to oil-soluble molybdenum additives for lubricating oil compositions include U.S. Pat. Nos. 4,164,473; 4,176,073; 4,176,074; 4,192,757; 4,248,720; 4,201,683; 4,289,635 and 4,479,883.

In particular, International patent application No. WO 00/71649 discloses the use of oil-soluble molybdenum compounds at levels providing from 10-350 ppm molybdenum to the lubricating oil. When used in combination with a particular zinc dialkyldithiophosphate, a particular base stock composition and a supplementary friction modifier, it is said that enhanced fuel economy and fuel economy retention can be obtained, despite the relatively low amount of molybdenum present in the lubricating oil composition.

U.S. Pat. No. 6,423,671 ('671) relates to lubricating compositions with improved frictional characteristics which translates into improved fuel economy when the compositions are used in internal combustion engines. In particular, '671 relates to lubricant compositions containing organo-molybdenum compounds together with zinc salts, metal-containing detergents and ashless friction modifiers (referred to as surfactants). '671 states that molybdenum compounds can improve frictional characteristics but that their effect is not fully realised in the above particular compositions because of preferred absorption on moving surfaces of the non-molybdenum polar components. This competition for absorption of polar components results, for example, in a tendency for detergents to be absorbed more readily than molybdenum compounds. '671 meets this problem by using dispersants to form a first semi-package with the aforementioned non-molybdenum polar components, the semi-package being made by mixing and heating the components, for example at about 90° C. for about 1-3 hours. The molybdenum component is provided in a second semi-package, and the first and second semi-packages added to an oil of lubricating viscosity.

A problem with the approach described in '671 is that it requires additional processing steps, particularly the preparation of the first semi-package. The problem of competition for absorption has also been addressed in a different way in International patent application No. WO 06/89799 by employing a detergent system of low metal ratio in a lubricating oil composition of low total base number (TBN).

EP 2,650,349A relates to lubricating oil compositions with improved frictional characteristics, fuel economy and fuel economy retention performance. The lubricating oil compositions comprise a molybdenum friction modifier in combination with a polymeric friction modifier that is the reaction product of a functionalised polyolefin, a polyether, a polyol and a monocarboxylic acid chain terminating group.

Fuel economy tests are becoming more closely aligned with engine operations and so fuel economy performance is critical in all temperature regimes including the low temperatures (e.g. ambient temperature (20° C.) to below 0° C.) present at engine start up. Accordingly, there is a need for crankcase lubricants which exhibit desirable friction characteristics thereby reducing friction losses in an engine and improving fuel economy and fuel economy retention performance, particularly fuel economy and fuel economy retention performance at low temperatures present at engine start up.

SUMMARY OF THE INVENTION

In accordance with a first aspect, the present invention provides a lubricating oil composition having a sulphated ash content of less than or equal to 1.2 mass % as determined by ASTM D874 and a phosphorous content of less than or equal to 0.12 mass % as determined by ASTM D5185, which lubricating oil composition comprises or is made by admixing:

(A) an oil of lubricating viscosity, in a major amount;

(B) an oil-soluble or oil-dispersible polymeric friction modifier as an additive in an effective minor amount, the polymeric friction modifier being the reaction product of solely:

(i) a functionalised polyolefin;

(ii) polyethylene glycol or polypropylene glycol or a mixed poly(ethylene-propylene) glycol; and, (iii) a monocarboxylic acid;

and, (C) at least one oil-soluble or oil-dispersible molybdenum compound as an additive in an effective minor amount.

Preferably, the lubricating oil composition of the present invention is a crankcase lubricant.

Unexpectedly, it has been found that the use of the oil-soluble or oil-dispersible polymeric friction modifier (B) as defined in the first aspect of the present invention, as an additive in an effective minor amount, in combination with the oil-soluble or oil-dispersible molybdenum compound as defined in the first aspect of the present invention, as an additive in an effective minor amount, in a lubricating oil composition comprising an oil of lubricating viscosity in a major amount typically provides a synergistic reduction in the friction coefficient between contacting metal surfaces which are lubricated with the lubricating oil composition. Accordingly, the significant reduction in friction and maintenance of such reduced friction levels between contacting metal surfaces lubricated with the lubricating oil composition typically translates into improved fuel economy and fuel economy retention performance, particularly low temperature fuel economy and fuel economy retention performance, in an engine lubricated with such a lubricating oil composition.

In accordance with a second aspect, the present invention provides a method of lubricating a spark-ignited or compression-ignited internal combustion engine comprising lubricating the engine with a lubricating oil composition as defined in accordance with the first aspect of the present invention.

In accordance with a third aspect, the present invention provides the use, in the lubrication of a spark-ignited or compression-ignited internal combustion engine, of an oil-soluble or oil-dispersible polymeric friction modifier (B) as defined in the first aspect of the invention, as an additive in an effective minor amount, in combination with an oil-soluble or oil-dispersible molybdenum compound as defined in the first aspect of the present invention, as an additive in an effective minor amount, in a lubricating oil composition comprising an oil of lubricating viscosity in a major amount, to improve the fuel economy performance, particularly the low temperature fuel economy performance, of the engine during operation of the engine.

In accordance with a fourth aspect, the present invention provides the use, in the lubrication of a spark-ignited or compression-ignited internal combustion engine, of a lubricating oil composition in accordance with the first aspect of the present invention to improve the fuel economy performance, particularly the low temperature fuel economy performance, of the engine during operation of the engine.

Suitably, the use of the third and fourth aspects of the present invention further improves the fuel economy retention properties, especially the low temperature fuel economy retention properties, of the engine during operation of the engine.

In accordance with a fifth aspect, the present invention provides the use, in the lubrication of a spark-ignited or compression ignited internal combustion engine, of an oil-soluble or oil-dispersible polymeric friction modifier (B) as defined in the first aspect of the invention, as an additive in an effective minor amount, in combination with an oil-soluble or oil-dispersible molybdenum compound as defined in the first aspect of the invention, as an additive in an effective minor amount, in a lubricating oil composition comprising an oil of lubricating viscosity in a major amount, to reduce the coefficient of friction between contacting metal surfaces in the engine during operation of the engine.

In accordance with a sixth aspect, the present invention provides the use, in the lubrication of a spark-ignited or compression-ignited internal combustion engine, of a lubricating oil composition in accordance with the first aspect of the present invention to reduce the coefficient of friction between contacting metal surfaces in the engine during operation of the engine.

In accordance with a seventh aspect, the present invention provides a method of improving the fuel economy performance, particularly the low temperature fuel economy performance, of an engine which method comprises lubricating the engine with a lubricating oil composition of the first aspect of the present invention and operating the engine.

Suitably, the method of the seventh aspect of the present invention further improves the fuel economy retention properties, especially the low temperature fuel economy retention properties, of the engine.

In accordance with an eighth aspect, the present invention provides a method of reducing the coefficient of friction between contacting metal surfaces in an engine which method comprises lubricating the engine with a lubricating oil composition of the first aspect of the present invention and operating the engine.

Suitably, the engine as defined in the seventh and eight aspects of the present invention is a spark-ignited or compression-ignited internal combustion engine.

Preferably, the lubricating oil composition of the first aspect of the present invention and as defined in the second, third, fourth, fifth, sixth, seventh and eighth aspects of the present invention further includes a dihydrocarbyl dithiophosphate metal salt, as an additive component in an effective minor amount.

Preferably, the lubricating oil composition of the first aspect of the present invention and as defined in the second, third, fourth, fifth, sixth, seventh and eighth aspects of the present invention further includes one or more co-additives in an effective minor amount, other than additive components (B) and (C), selected from ashless dispersants, metal detergents, corrosion inhibitors, antioxidants, pour point depressants, antiwear agents, friction modifiers, demulsifiers, antifoam agents and viscosity modifiers.

The lubricating oil composition of the present invention has a sulphated ash content of less than or equal to 1.2, preferably less than or equal to 1.1, more preferably less than or equal to 1.0, mass % (ASTM D874) based on the total mass of the composition.

Preferably, the lubricating oil composition of the present invention contains low levels of phosphorus. Suitably, the lubricating oil composition contains phosphorus in an amount of less than or equal to 0.12 mass %, preferably up to 0.11 mass %, more preferably less than or equal to 0.10 mass %, even more preferably less than or equal to 0.09 mass %, even more preferably less than or equal to 0.08 mass %, most preferably less than or equal to 0.06, mass % of phosphorus (ASTM D5185) based on the total mass of the composition. Suitably, the lubricating oil composition contains phosphorus in an amount of greater than or equal to 0.01, preferably greater than or equal to 0.02, more preferably greater than or equal to 0.03, even more preferably greater than or equal to 0.05, mass % of phosphorus (ASTM D5185) based on the total mass of the composition.

Typically, the lubricating oil composition may contain low levels of sulfur. Preferably, the lubricating oil composition contains sulphur in an amount of up to 0.4, more preferably up to 0.3, even more preferably up to 0.2, mass % sulphur (ASTM D2622) based on the total mass of the composition.

Typically, a lubricating oil composition according to the present invention, contains up to 0.30, more preferably up to 0.20, most preferably up to 0.15, mass % nitrogen, based on the total mass of the composition and as measured according to ASTM method D5291.

Suitably, the lubricating oil composition may have a total base number (TBN), as measured in accordance with ASTM D2896, of 4 to 15, preferably 5 to 12 mg KOH/g.

In this specification, the following words and expressions, if and when used, have the meanings given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains hydrogen and carbon atoms and that is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the group consists essentially of hydrogen and carbon atoms, unless specified otherwise. Preferably, the hydrocarbyl group comprises an aliphatic hydrocarbyl group. The term "hydrocarbyl" includes "alkyl", "alkenyl", "allyl" and "aryl" as defined herein;

"alkyl" means a $C_1$ to $C_{30}$ alkyl group which is bonded to the remainder of the compound directly via a single carbon atom. Unless otherwise specified, alkyl groups may, when there are a sufficient number of carbon atoms, be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl;

"alkynyl" means a $C_2$ to $C_{30}$, preferably a $C_2$ to $C_{12}$, group which includes at least one carbon to carbon triple bond and is bonded to the remainder of the compound directly via a single carbon atom, and is otherwise defined as "alkyl";

"aryl" means a $C_6$ to $C_{18}$, preferably $C_6$ to $C_{10}$, aromatic group, optionally substituted by one or more alkyl groups, halo, hydroxyl, alkoxy and amino groups, which is bonded to the remainder of the compound directly via a single carbon atom. Preferred aryl groups include phenyl and naphthyl groups and substituted derivatives thereof, especially phenyl and alkyl substituted derivatives thereof;

"alkenyl" means a $C_2$ to $C_{30}$, preferably a $C_2$ to $C_{12}$, group which includes at least one carbon to carbon double bond and is bonded to the remainder of the compound directly via a single carbon atom, and is otherwise defined as "alkyl";

"alkylene" means a $C_2$ to $C_{20}$, preferably a $C_2$ to $C_{10}$, more preferably a $C_2$ to $C_6$ bivalent saturated acyclic aliphatic radical which may be linear or branched. Representative examples of alkylene include ethylene, propylene, butylene, isobutylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene;

"polyol" means an alcohol which includes two or more hydroxyl functional groups (i.e. a polyhydric alcohol) but excludes a "polyethylene glycol", a "polypropylene glycol" and a "mixed poly(ethylene-propylene) glycol" (i.e. component B(ii)) which is used to form the oil-soluble or oil-dispersible polymeric friction modifier. More specifically, the term "polyol" embraces a dial, triol, tetrol, and/or related dimers or chain extended polymers of such compounds. Even more specifically, the term "polyol" embraces glycerol, neopentyl glycol, trimethylolethane, trimethylolpropane, trimethylolbutane, pentaerythritol, dipentaerythritol, tripentaerythritol and sorbitol;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means in excess of 50 mass % of a composition expressed in respect of the stated component and in respect of the total mass of the composition, reckoned as active ingredient of the component;

"minor amount" means less than 50 mass % of a composition, expressed in respect of the stated additive and in respect of the total mass of the composition, reckoned as active ingredient of the additive;

"effective minor amount" in respect of an additive means an amount of such an additive in a lubricating oil composition so that the additive provides the desired technical effect;

"ppm" means parts per million by mass, based on the total mass of the lubricating oil composition;

"metal content" of the lubricating oil composition or of an additive component, for example molybdenum content or total metal content of the lubricating oil composition (i.e. the sum of all individual metal contents), is measured by ASTM D5185;

"TBN" in relation to an additive component or of a lubricating oil composition of the present invention, means total base number (mg KOH/g) as measured by ASTM D2896;

"$KV_{100}$" means kinematic viscosity at 100° C. as measured by ASTM D445;

"phosphorus content" is measured by ASTM D5185;

"sulfur content" is measured by ASTM D2622; and,

"sulfated ash content" is measured by ASTM D874.

All percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, $mm^2/s$ (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Whilst the composition of the base oil will depend upon the particular application of the lubricating oil composition and the oil formulator will chose the base oil to achieve desired performance characteristics at reasonable cost, the base oil of a lubricating oil composition according to the present invention typically comprises no more than 85 mass % Group IV base oil, the base oil may comprise no more than 70 mass % Group IV base oil, or even no more than 50 mass % Group IV base oil. The base oil of a lubricating oil composition according to the present invention may comprise 0 mass % Group IV base oil. Alternatively, the base oil of a lubricating oil composition according to the present invention may comprise at least 5 mass %, at least 10 mass % or at least 20 mass % Group IV base oil. The base oil of a lubricating oil composition according to the present invention may comprise from 0 to 85 mass %, or from 5-85 mass %, alternatively from 10-85 mass % Group IV base oil.

Preferably, the volatility of the oil of lubricating viscosity or oil blend, as measured by the NOACK test (ASTM D5800), is less than or equal to 20%, preferably less than or equal to 16%, preferably less than or equal to 12%, more preferably less than or equal to 10%. Preferably, the viscosity index (VI) of the oil of lubricating viscosity is at least 95, preferably at least 110, more preferably up to 120, even more preferably at least 120, even more preferably at least 125, most preferably from about 130 to 140.

The oil of lubricating viscosity is provided in a major amount, in combination with a minor amount of additive components (B) and (C), as defined herein and, if necessary, one or more co-additives, such as described hereinafter, constituting a lubricating oil composition. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

When concentrates are used to make the lubricating oil compositions, they may for example be diluted with 3 to 100, e.g. 5 to 40, parts by mass of oil of lubricating viscosity per part by mass of the concentrate.

Preferably, the lubricating oil composition is a multigrade oil identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of a SAE 5WX or SAE 0WX, wherein X represents any one of 20, 30, 40 and 50. Preferably X is 20 or 30.

Polymeric Friction Modifier (B)

The oil-soluble or oil-dispersible polymeric friction modifier (B) is the reaction product of solely:

(i) a functionalised polyolefin;

(ii) polyethylene glycol or polypropylene glycol or a mixed poly(ethylene-propylene) glycol; and, (iii) a monocarboxylic acid.

By the word "solely", we mean the oil-soluble or oil-dispersible polymeric friction modifier (B), as defined in each aspect of the present invention, is a copolymer derived from the reaction of only the functionalised polyolefin (B(i)) with the polyethylene glycol or polypropylene glycol or a mixed poly(ethylene-propylene) glycol (B(ii)) and which copolymer is terminated (i.e. chain terminated) by reaction with the monocarboxylic acid.

The polymeric friction modifier (B), as defined herein and in each aspect of the present invention, does not include the reaction product of (i) a functionalised polyolefin; (ii) a polyalkylene glycol (e.g. a polyethylene glycol or polypropylene glycol or a mixed poly(ethylene-propylene) glycol); (iii) a monocarboxylic acid; and, (iv) a polyol. In other words, the polymeric friction modifier (B), as defined in each aspect of the present invention, does not include a backbone moiety derived from a polyol which is capable of reacting with the functionalised polyolefin or the copolymer reaction product derived from the reaction of (B(i)) with (B(ii)). Accordingly, in the polymeric friction modifier (B), as defined in each aspect of the present invention, the functionalised polyolefin (B(i)) and the polyethylene glycol or polypropylene glycol or a mixed poly(ethylene-propylene) glycol (B(ii)) are bonded directly to one another, via an appropriate functional group (e.g. via an ester group where the functionalised polyolefin includes a diacid or anhydride functional group), and hence form an essentially polyolefin-polyethylene glycol copolymer or polyolefin-polypropylene glycol copolymer or polyolefin-poly(ethylene-propylene) glycol copolymer which copolymer chain is terminated by reaction with the monocarboxylic acid (e.g. a free hydroxyl group of the polyethylene glycol or polypropylene glycol or a mixed poly(ethylene-propylene) glycol moiety in the copolymer forms an ester by reaction with the monocarboxylic acid).

Suitably, the lubricating oil composition of the present invention also does not include a polymeric friction modifier which is the reaction product of (i) a functionalised polyolefin; (ii) a polyalkylene glycol (e.g. a polyethylene glycol or polypropylene glycol or a mixed poly(ethylene-propylene) glycol); (iii) a monocarboxylic acid; and, (iv) a polyol.

The Functionalised Polyolefin (B(i))

The functionalised polyolefin is preferably derived from polymerisation of an olefin, especially a mono-olefin, having from 2 to 6 carbon atoms, such as ethylene, propylene, but-1-ene and isobutylene (i.e. 2-methyl propene) and the resulting polyolefin functionalised with an appropriate functional group. Accordingly, the functionalised polyolefin may be regarded as a functionalised poly($C_2$ to $C_6$ alkylene). Even more preferably, the functionalised polyolefin is derived from polymerisation of isobutylene and the resulting polyisobutylene functionalised with an appropriate functional group (i.e. the functionalised polyolefin is functionalised polyisobutylene).

The polyolefin of the functionalised polyolefin suitably includes a chain of 15 to 500, preferably 50 to 200, carbon atoms. Suitably, the polyolefin of the functionalised polyolefin has a number average molecular weight (Mn) of from 300 to 5000, preferably 500 to 1500, especially 800 to 1200 daltons.

The functionalised polyolefin includes at least one functional group which is capable of reacting with a hydroxyl functional group of the polyethylene glycol or polypropylene glycol or a mixed poly(ethylene-propylene) glycol (B(ii)) thereby forming an essentially polyolefin-polyethylene glycol copolymer or polyolefin-polypropylene glycol copolymer or polyolefin-poly(ethylene-propylene) glycol copolymer. Accordingly, the functionalised polyolefin may comprise a diacid or anhydride functional group from reaction of the polyolefin with an unsaturated diacid or anhydride; alternatively, the functionalised polyolefin may comprise an epoxide functional group from reaction with a peracid, for example perbenzoic acid or peracetic acid. Preferably, the functionalised polyolefin includes an anhydride functional group. Suitably the anhydride functionalised polyolefin is derived from the reaction of the polyolefin with an anhydride, especially maleic anhydride which forms a succinic anhydride functional group. Accordingly, the functionalised polyolefin includes an anhydride functional group, especially a succinic anhydride functional group.

Accordingly, a preferred functionalised polyolefin is a polyolefin which includes an anhydride functional group, more preferably a functionalised poly($C_2$ to $C_6$ alkylene) which includes an anhydride functional group, even more preferably a functionalised poly($C_2$ to $C_6$ alkylene) which includes a succinic anhydride functional group, especially a polyisobutylene (PIB) which includes a succinic anhydride functional group—namely polyisobutylene succinic anhydride (PIBSA). Suitably, the polyisobutylene of the PIBSA has a number average molecular weight (Mn) of from 300 to 5000, preferably 500 to 1500, especially 800 to 1200 daltons. PIB is a commercially available compound and sold under the trade name of Glissopal by BASF and this product can be reacted to give a functionalised polyolefin (B(i)).

Reactant (B(ii))

Reactant (B(ii)) which is used in the formation of the oil-soluble or oil-dispersible polymeric friction modifier is polyethylene glycol or polypropylene glycol or a mixed poly(ethylene-propylene) glycol. Preferably, reactant (B(ii)) is polyethylene glycol (PEG), especially a water soluble PEG.

The polyethylene glycol or polypropylene glycol or mixed poly(ethylene-propylene) glycol includes two hydroxyl groups which are capable of reacting with the functional group of the functionalised polyolefin, thereby forming an essentially polyolefin-polyethylene glycol copolymer or polyolefin-polypropylene glycol copolymer or polyolefin-poly(ethylene-propylene) glycol copolymer.

Suitably, the reactant (B(ii)), namely polyethylene glycol or polypropylene glycol or a mixed poly(ethylene-propylene) glycol, especially PEG, has a number average molecular weight (Mn) of from 300 to 5000, preferably 400 to 1000, especially 400 to 800, daltons. Accordingly, in a preferred embodiment reactant (B(ii)) is $PEG_{400}$, $PEG_{600}$ or $PEG_{1000}$. Suitably, $PEG_{400}$, $PEG_{600}$ and $PEG_{1000}$ are commercially available from Croda International.

As mentioned previously, the functionalised polyolefin and the polyethylene glycol or polypropylene glycol or a mixed poly(ethylene-propylene) glycol react to form a copolymer. Accordingly, the functionalised polyolefin and the polyethylene glycol or polypropylene glycol or mixed poly (ethylene-propylene) glycol may react to form a block copolymer. When present the number of block copolymer units in the organic friction modifier additive typically ranges from 2 to 20, preferably 2 to 15, more preferably 2 to 10, units.

The Monocarboxylic Acid (B(iii))

Suitably the copolymer reaction product of the functionalised polyolefin (B(i)) and the polyethylene glycol or polypropylene glycol or a mixed poly(ethylene-propylene) glycol (B(ii)) includes a reactive hydroxyl functional group (i.e. a hydroxyl group associated with polyethylene glycol or polypropylene glycol or a mixed poly(ethylene-propylene) glycol moiety) and such copolymer is reacted with a monocarboxylic acid, thereby chain terminating the copolymer product of reaction (i.e. the monocarboxylic acid reacts with a hydroxyl functional group associated with a polyethylene glycol or polypropylene glycol or a mixed poly(ethylene-propylene) glycol moiety to form an ester, thereby chain terminating the copolymer).

Suitably the monocarboxylic acid is a $C_2$ to $C_{36}$ hydrocarbyl monocarboxylic acid, preferably a $C_6$ to $C_{30}$ hydrocarbyl monocarboxylic acid, more preferably a $C_{12}$ to $C_{22}$ hydrocarbyl monocarboxylic acid. Even more preferred monocarboxylic acids are saturated or unsaturated, branched or linear, acyclic $C_2$ to $C_{36}$ aliphatic hydrocarbyl monocarboxylic acids, especially saturated or unsaturated, branched or linear, acyclic $C_6$ to $C_{30}$ aliphatic hydrocarbyl monocarboxylic acids, more especially saturated or unsaturated, branched or linear, acyclic $C_{12}$ to $C_{22}$ aliphatic hydrocarbyl monocarboxylic acids. Even more preferably, the monocarboxylic acid is an unsaturated acyclic $C_6$ to $C_{30}$ aliphatic hydrocarbyl monocarboxylic acid, more especially an unsaturated, acyclic $C_{12}$ to $C_{22}$ aliphatic hydrocarbyl monocarboxylic acid.

In preferred embodiments the carboxylic acid is chosen from the group comprising lauric acid, erucic acid, isostearic acid, palmitic acid, tall oil fatty acid, oleic acid and linoleic acid, especially oleic acid.

Thus according to a highly preferred embodiment the oil-soluble or oil-dispersible polymeric friction modifier (B) is the reaction product of solely:

(i) PIBSA, as defined herein;

(ii) polyethylene glycol, as defined herein; and, (iii) a monocarboxylic acid, as defined herein, especially oleic acid.

As with all polymers, the polymeric friction modifier (B) will typically comprise a mixture of molecules of various sizes. The polymeric friction modifier (B) suitably has a number average molecular weight of from 1,000 to 30,000, preferably from 1,500 to 25,000, more preferably from 2,000 to 20,000, daltons.

The polymeric friction modifier (B) suitably has an acid value of less than 20, preferably less than 15 and more preferably less than 10 mg KOH/g (ASTM D974). The polymeric friction modifier (B) suitably has an acid value of greater than 1, preferably greater than 1.5 mg KOH/g. In a preferred embodiment, the polymeric friction modifier (B) has an acid value in the range of 1.5 to 9 mg KOH/g.

Suitably, the polymeric friction modifier (B) may be prepared by analogous synthetic methodology as described in International Patent Application no. WO 2011/107739.

In a preferred embodiment the polymeric friction modifier (B) is the reaction product of maleinised polyisobutylene (PIBSA), PEG, and oleic acid, wherein the polyisobutylene of the maleinised polyisobutylene has a number average molecular weight of around 950 daltons, the PIBSA has an approximate saponification value of 98 mg KOH/g and the PEG has a number average molecular weight of around 600 daltons and a hydroxyl value of 190 mg KOH/g. A suitable additive may be made by charging 166.5 g (0.135 mol) of PIBSA, 135.3 g (0.226 mol) of $PEG_{600}$ and 34.3 g (0.121 mol) of oleic acid into a glass round bottomed flask equipped with a nitrogen purge, mechanical stirrer, isomantle heater and overhead condenser. The reaction takes place in the presence of 0.5 ml of esterification catalyst tetrabutyl titanate at 180-230° C., with removal of water to a final acid value of 1.7 mg KOH/g.

The polymeric friction modifier (B) is suitably present in the lubricating oil composition of the present invention, on an active matter basis, in an amount of at least 0.1, preferably at least 0.2, mass % based on the total mass of the lubricating oil composition. The polymeric friction modifier of the present invention is suitably present in the lubricating oil composition, on an active matter basis, in an amount of less than or equal to 5, preferably less than or equal to 3, more preferably less than or equal to 1.5, mass %, based on the total mass of the lubricating oil composition.

Oil-Soluble Molybdenum Compound (C)

For the lubricating oil compositions of the present invention, any suitable oil-soluble or oil-dispersible molybdenum compound having friction modifying properties in lubricating oil compositions may be employed. Preferably, the oil-soluble or oil-dispersible molybdenum compound is an oil-soluble or oil-dispersible organo-molybdenum compound. As examples of such organo-molybdenum compounds, there may be mentioned molybdenum dithiocarbamates, molybdenum dithiophosphates, molybdenum dithiophosphinates, molybdenum xanthates, molybdenum thioxanthates, molybdenum sulfides, and the like, and mixtures thereof. Particularly preferred are molybdenum dithiocarbamates, molybdenum dialkyldithiophosphates, molybdenum alkyl xanthates and molybdenum alkylthioxanthates. An especially preferred organo-molybdenum compound is a molybdenum dithiocarbamate.

The molybdenum compound may be mono-, di-, tri- or tetra-nuclear. Di-nuclear and tri-nuclear molybdenum compounds are preferred, especially preferred are tri-nuclear molybdenum compounds. Preferably, the oil-soluble or oil-dispersible molybdenum compound is an oil-soluble or oil-dispersible organo-molybdenum compound. Suitably, a preferred organo-molybdenum compound includes a di- or tri-nuclear organo-molybdenum compound, more preferably a di- or tri-nuclear molybdenum dithiocarbamate, especially a tri-nuclear molybdenum dithiocarbamate.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Among the molybdenum compounds useful in the compositions of this invention are organo-molybdenum compounds of the formulae $Mo(ROCS_2)_4$ and $Mo(RSCS_2)_4$, wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are tri-nuclear organo-molybdenum compounds, especially those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of:

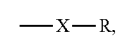

1

-continued

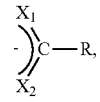

2

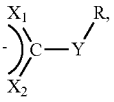

3 and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as

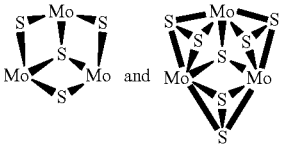

and have net charges of +4. Consequently, in order to solubilize these cores the total charge among all the ligands must be −4. Four mono-anionic ligands are preferred. Without wishing to be bound by any theory, it is believed that two or more tri-nuclear cores may be bound or interconnected by means of one or more ligands and the ligands may be multidentate. This includes the case of a multidentate ligand having multiple connections to a single core. It is believed that oxygen and/or selenium may be substituted for sulfur in the core(s).

Oil-soluble or oil-dispersible tri-nuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a tri-nuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. Preferably, at least 21 total carbon atoms should be present among all the ligands' organo groups. Preferably, the ligand source chosen has a sufficient number of carbon atoms in its organo groups to render the compound soluble or dispersible in the lubricating composition.

The lubricating oil composition of the present invention may contain the molybdenum compound in an amount providing the composition with greater than or equal to 10, preferably greater than or equal to 20, more preferably greater than or equal to 40, ppm by mass of molybdenum (ASTM D5185), based on the total mass of the lubricating oil composition. The lubricating oil compositions of the present invention may contain the molybdenum compound in an amount providing the composition with less than or equal to 1000, preferably less than or equal to 700, more preferably less than or equal to 500, ppm by mass of molybdenum (ASTM D5185), based on the total mass of the lubricating oil composition. Preferred embodiments of the present invention contain the molybdenum compound in an amount providing the composition with from 10 to 1000, more preferably from 10 to 700, still more preferably from 10 to 500, ppm by mass of molybdenum (ASTM D5185), based on the total mass of the lubricating oil composition.

Engines

The lubricating oil compositions of the invention may be used to lubricate mechanical engine components, particularly in internal combustion engines, e.g. spark-ignited or compression-ignited internal combustion engines, particularly spark-ignited or compression-ignited two- or four-stroke reciprocating engines, by adding the composition thereto. The engines may be conventional gasoline or diesel engines designed to be powered by gasoline or petroleum diesel, respectively; alternatively, the engines may be specifically modified to be powered by an alcohol based fuel or biodiesel fuel.

Co-Additives

Co-additives, with representative effective amounts, that may also be present, different from additive components (B) and (C), are listed below. All the values listed are stated as mass percent active ingredient in a fully formulated lubricant.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |

-continued

| Additive | Mass % (Broad) | Mass % (Preferred) |
|---|---|---|
| Anti-Foaming Agent | 0-5 | 0.001-0.15 |
| Supplement Anti-Wear Agents | 0-5 | 0-2 |
| Viscosity Modifier (1) | 0-10 | 0.01-4 |
| Mineral or Synthetic Base Oil | Balance | Balance |

(1) Viscosity modifiers are used only in multi-graded oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

Suitably, the lubricating oil composition includes one or more co-additives in a minor amount, other than additive components (B) and (C), selected from ashless dispersants, metal detergents, corrosion inhibitors, antioxidants, pour point depressants, antiwear agents, friction modifiers, demulsifiers, antifoam agents and viscosity modifiers.

The above mentioned co-additives are discussed in further detail as follows; as is known in the art, some additives can provide a multiplicity of effects, for example, a single additive may act as a dispersant and as an oxidation inhibitor.

Metal detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80 mg KOH/g. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 mg KOH/g or greater, and typically will have a TBN of from 250 to 450 mg KOH/g or more. In the presence of the compounds of Formula 1, the amount of overbased detergent can be reduced, or detergents having reduced levels of overbasing (e.g., detergents having a TBN of 100 to 200 mg KOH/g), or neutral detergents can be employed, resulting in a corresponding reduction in the SASH content of the lubricating oil composition without a reduction in the performance thereof.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

In one embodiment of the present invention, the lubricating oil composition includes metal detergents that are chosen from neutral or overbased calcium sulfonates having TBN of from 20 to 450 mg KOH/g, and neutral and overbased calcium phenates and sulfurized phenates having TBN of from 50 to 450 mg KOH/g, and mixtures thereof.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

In another embodiment of the present invention, the lubricating oil composition comprises metal detergents that are neutral or overbased alkali or alkaline earth metal salicylates having a TBN of from 50 to 450 mg KOH/g, preferably a TBN of 50 to 250 mg KOH/g, or mixtures thereof. Highly preferred salicylate detergents include alkaline earth metal salicylates, particularly magnesium and calcium, especially, calcium salicylates. In one embodiment of the present invention, alkali or alkaline earth metal salicylate detergents are the sole metal-containing detergent in the lubricating oil composition.

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

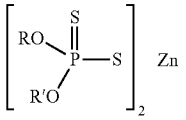

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

The ZDDP is added to the lubricating oil compositions in amounts sufficient to provide no greater than 1200 ppm, preferably no greater than 1000 ppm, more preferably no greater than 900 ppm, most preferably no greater than 850 ppm by mass of phosphorous to the lubricating oil, based upon the total mass of the lubricating oil composition, and as measured in accordance with ASTM D5185. The ZDDP is suitably added to the lubricating oil compositions in amounts sufficient to provide at least 100 ppm, preferably at least 350 ppm, more preferably at least 500 ppm by mass of phosphorous to the lubricating oil, based upon the total mass of the lubricating oil composition, and as measured in accordance with ASTM D5185.

Examples of ashless anti-wear agents include 1,2,3-triazoles, benzotriazoles, sulfurised fatty acid esters, and dithiocarbamate derivatives.

Ashless dispersants comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil-soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Additional Ashless Friction modifiers, such as nitrogen-free organic friction modifiers are useful in the lubricating oil compositions of the present invention and are known generally and include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

Preferred organic ashless nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines, which improve boundary layer lubrication. One common class of such metal free, nitrogen-containing friction modifier comprises ethoxylated alkyl amines. They may be in the form of an adduct or reaction product with a boron compound such as a boric oxide, boron halide, metaborate, boric acid or a mono-, di- or tri-alkyl borate. Another metal free, nitrogen-containing friction modifier is an ester formed as the reaction product of (i) a tertiary amine of the formula $R_1R_2R_3N$ wherein $R_1$, $R_2$ and $R_3$ represent aliphatic hydrocarbyl, preferably alkyl, groups having 1 to 6 carbon atoms, at least one of $R_1$, $R_2$ and $R_3$ having a hydroxyl group, with (ii) a saturated or unsaturated fatty acid having 10 to 30 carbon atoms. Preferably, at least one of $R_1$, $R_2$ and $R_3$ is an alkyl group. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid. A preferred embodiment comprises a mixture of esters formed as the reaction product of (i) a tertiary hydroxy amine of the formula $R_1R_2R_3N$ wherein $R_1$, $R_2$ and $R_3$ may be a $C_2$-$C_4$ hydroxy alkyl group with (ii) a saturated or unsaturated fatty acid having 10 to 30 carbon atoms, with a mixture of esters so formed comprising at least 30-60 mass %, preferably 45-55 mass % diester, such as 50 mass % diester, 10-40 mass %, preferably 20-30 mass % monoester, e.g. 25 mass % monoester, and 10-40 mass %, preferably 20-30 mass % triester, such as 25 mass % triester. Suitably, the ester is a mono-, di- or tri-carboxylic acid ester of triethanolamine and mixtures thereof.

Typically, the total amount of additional organic ashless friction modifier in a lubricant according to the present invention does not exceed 5 mass %, based on the total mass of the lubricating oil composition and preferably does not exceed 2 mass % and more preferably does not exceed 0.5 mass %. In an embodiment of the present invention, the lubricating oil composition contains no additional organic ashless friction modifier.

Viscosity modifiers (VM) function to impart high and low temperature operability to a lubricating oil. The VM used may have that sole function, or may be multifunctional. Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Anti-oxidants, sometimes referred to as oxidation inhibitors, increase the resistance of the composition to oxidation and may work by combining with and modifying peroxides to render them harmless, by decomposing peroxides, or by rendering oxidation catalysts inert. Oxidative deterioration can be evidenced by sludge in the lubricant, varnish-like deposits on the metal surfaces, and by viscosity growth.

Examples of suitable antioxidants are selected from copper-containing antioxidants, sulfur-containing antioxidants, aromatic amine-containing antioxidants, hindered phenolic antioxidants, dithiophosphates derivatives, and metal thiocarbamates. Preferred anti-oxidants are aromatic amine-containing antioxidants, hindered phenolic antioxidants and mixtures thereof. In a preferred embodiment, an antioxidant is present in a lubricating oil composition of the present invention.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1, 3, 4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient or elevated temperatures.

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Typically, the additive package used to formulate the lubricating oil composition according to the present invention has a total base number (TBN) as measured by ASTM D2896 of 25 to 100, preferably 45 to 80, and the lubricating oil composition according to the present invention has a total base number (TBN) as measured by ASTM D2896 of 4 to 15, preferably 5 to 12. In an embodiment of the present invention, the additive package does not have a total base number (TBN) as measured by ASTM D2896 of between 62 and 63.5 and the lubricating oil composition does not have a total base number (TBN) as measured by ASTM D2896 of between 9.05 and 9.27.

The final crankcase lubricating oil formulation may employ from 2 to 20, preferably 4 to 18, and most preferably 5 to 17, mass % of the concentrate or additive package with the remainder being base stock.

In an embodiment of the present invention, a lubricating oil composition according to the first aspect of the invention does not comprise 0.2-0.25 mass % of sulphur as measured according to ASTM method D4927.

In an embodiment of the present invention, a lubricating oil composition according to the first aspect of the invention does not comprise 0.08-0.11 mass % of nitrogen as measured according to ASTM method D5291.

EXAMPLES

The invention will now be described in the following examples which are not intended to limit the scope of the claims hereof.

Example 1 Preparation of Polymeric Friction Modifier (B)

A 500 $cm^3$ 5-necked round-bottomed flask equipped with a nitrogen purge, stirrer with PTFE guide, temperature probe and distillation arm attached to an exit bubbler was charged with PIBSA (116.5 g, 0.135 mol), $PEG_{600}$ (135.3 g, 0.226 mol) and oleic acid (34.3 g, 0.121 mol) and the mixture heated at 180° C. with stirring for 1 hour. The reaction mixture was then heated to a temperature of 230° C. for 1 hour and then tetrabutyl titanate (0.5 ml) added thereto and heating and stirring continued for 6 hours at a temperature of 230° C. The reaction mixture was cooled to below 100° C. and the polymeric friction modifier (B) poured from the round bottom flask. The polymeric friction modifier (B) had an acid value of 1.7 mgKOH/g.

Example 2 Boundary Regime Friction Characteristics

Five oil samples were prepared according to the Table 1. The quantities given are on an active matter basis.

TABLE 1

| Component | Oil 1 Mass % | Oil 2 Mass % | Oil 3 Mass % | Oil 4 Mass % | Oil 5 Mass % |
|---|---|---|---|---|---|
| Base oil[1] | 100 | 99.39 | 99.64 | 99.39 | 99.39 |
| B Polymeric Friction Modifier[2] | — | 0.61 | — | — | 0.25 |
| C Molybdenum Compound[3] | — | — | 0.36 | 0.61 | 0.36 |

[1]The base oil was SN150 Group I base stock.

[2]The friction modifier was a compound of Example 1.

[3]The molybdenum compound was Infineum C9455 B, a molybdenum dithiocarbamate available from Infineum UK Ltd.

Oil 1 is an unmodified base oil. Oils 2 to 5 contain either the polymeric friction modifier (B) only (Oil 2), a molybdenum additive only (Oils 3 and 4) or a combination of the polymeric friction modifier (B) and a molybdenum additive (Oil 5 which is a lubricant of the invention). In order to illustrate the effect of the friction modifier and molybdenum additive, no other additives were present in the Oils 2 to 5.

A high frequency reciprocating rig (HFRR—supplied by PCS Instruments) was used to evaluate the boundary regime friction characteristics of Oils 1 to 5. The rig was set up with a 6 mm ball on a 10 mm disc. The test protocol employed was as follows:

| | |
|---|---|
| Test Duration (mins) | 60 |
| Test Load (N) | 4 |
| Frequency (Hz) | 20 |
| Stroke Length (microns) | 1,000 |
| Temperature (° C.) | 60 |

The results are set out in Table 2 and they represent the initial friction (1 second) and friction once equilibrium has been reached (1501 seconds).

TABLE 2

| Time (s) | Oil 1 | Oil 2 | Oil 3 | Oil 4 | Oil 5 |
|---|---|---|---|---|---|
| 1 | 0.004 | 0.003 | 0.003 | 0.004 | 0.004 |
| 1501 | 0.153 | 0.142 | 0.141 | 0.133 | 0.068 |
| 1801 | 0.155 | 0.142 | 0.141 | 0.135 | 0.071 |
| 2101 | 0.159 | 0.147 | 0.144 | 0.137 | 0.073 |
| 2401 | 0.156 | 0.147 | 0.145 | 0.137 | 0.074 |
| 2701 | 0.158 | 0.147 | 0.15 | 0.139 | 0.072 |
| 3001 | 0.155 | 0.148 | 0.157 | 0.136 | 0.072 |
| 3301 | 0.154 | 0.149 | 0.163 | 0.135 | 0.071 |
| 3596 | 0.156 | 0.151 | 0.169 | 0.13 | 0.073 |

It can be seen from the results in Table 2, that the unmodified base stock has a fairly constant friction coefficient. Oil 2 containing only the polymeric friction modifier (B) shows some improvement in friction coefficient compared to the unmodified base oil. Looking at the effect of the molybdenum additive (C), the benefits of molybdenum at the lower treat rate of Oil 3 is variable and is not sustained over a longer period. At the higher treat rate of Oil 4, there is some improvement in friction coefficient.

Looking now at Oil 5 with its combination of friction modifier (B) and molybdenum compound (C), it can be seen that there is a synergistic effect produced from this combination. The data in Table 2 clearly shows that this combination affects a significant reduction in friction coefficient compared to the oils containing only one of these additives at either the lower or higher treat rates. This significant reduction in friction coefficient cannot be expected from the performance of the individual additives and is significantly more than a cumulative benefit of the two additives. Such a significant reduction in friction coefficient will be beneficial in obtaining improved fuel economy performance.

Example 3 Mixed Regime Friction Characteristics

Two oil samples were prepared according to the Table 3. The quantities given are on an active matter basis.

TABLE 3

| Component | Oil 6 Mass % | Oil 7 Mass % |
|---|---|---|
| Base oil[1] | 99.39 | 99.39 |
| B Polymeric Friction Modifier 1[2] | 0.25 | — |

TABLE 3-continued

| Component | Oil 6 Mass % | Oil 7 Mass % |
|---|---|---|
| C Polymeric Friction Modifier 2[3] | — | 0.25 |
| D Molybdenum Compound[4] | 0.36 | 0.36 |

[1]The base oil was SN150 Group I base stock.

[2]The friction modifier was Perfad 3000 available from Croda International and is a polymer formed by reacting maleinised polyisobutylene (PIBSA), polyethylene glycol, glycerol and tall oil fatty acid as described in WO 2011/107739.

[3]The friction modifier was a compound of Example 1.

[4]The molybdenum compound was Infineum C9455 B, a molybdenum dithiocarbamate available from Infineum UK Ltd.

Oil 6 is a comparative lubricant and includes an organo-molybdenum additive and the polymeric friction modifier Perfad 3000 available from Croda International, Oil 7 represents a lubricant of the invention and includes an organo-molybdenum additive and the polymeric friction modifier of Example 1. In order to illustrate the effect of the friction modifier and molybdenum additive, no other additives were present in the Oils 6 and 7.

A mini traction machine (MTM2—supplied by PCS Instruments) was employed to evaluate the mixed friction characteristics of Oils 6 and 7. The MTM is a bench-top tribological rig where a ¾ inch diameter steel ball is loaded against the flat surface of a 46 mm diameter steel disc. The ball and disc each rotate about their axis independently, thereby allowing a range of sliding and rolling conditions to be achieved in the contact zone. The lubricant containing the ball and disc is heated to a predetermined temperature by means of a heating unit and thermocouple arrangement. The primary function of the MTM is to examine the formation of tribological films between the ball and disc and to measure traction across the mixed lubrication regime. The data output from the rig are in the form of a Stribeck curve, namely traction data are recorded as the relative speeds of the ball and disc are varied, thereby providing a plot of traction against mean rolling speed.

The results are set out in Table 4 and represent the coefficient of friction at different rolling speeds at a temperature of 135° C. and a load of 30 Newtons.

TABLE 4

| Rolling Speed (mm/s) | Oil 6 | Oil 7 | % Improvement of Oil 7 versus Oil 6 |
|---|---|---|---|
| 200 | 0.0453 | 0.0442 | 2.43 |
| 100 | 0.056 | 0.0527 | 5.89 |
| 90 | 0.0564 | 0.0537 | 4.79 |

TABLE 4-continued

| Rolling Speed (mm/s) | Oil 6 | Oil 7 | % Improvement of Oil 7 versus Oil 6 |
|---|---|---|---|
| 50 | 0.0594 | 0.0561 | 5.56 |
| 20 | 0.059 | 0.0547 | 7.29 |

It can be seen from the results in Table 4, that a lubricant of the invention (Oil 7) exhibits improved mixed friction characteristics at all rolling speeds compared with the comparative lubricant, Oil 6. In particular, Oil 7 shows a maximum reduction in the coefficient of friction of 7.29% compared to comparative Oil 6 at a rolling speed of 20 mm/s.

What is claimed is:

1. A lubricating oil composition having a sulphated ash content of less than or equal to 1.2 mass % as determined by ASTM D874 and a phosphorous content of less than or equal to 0.12 mass % as determined by ASTM D5185, which lubricating oil composition comprises or is made by admixing:

(A) an oil of lubricating viscosity, in a major amount;

(B) from about 0.2 to about 1.5 mass % on an active matter basis, of an oil-soluble or oil-dispersible polymeric friction modifier as an additive, the polymeric friction modifier being the reaction product of solely:

(i) polyisobutene functionalized with a diacid or anhydride functional group;

(ii) polyethylene glycol or polypropylene glycol or a mixed poly(ethylene-propylene) glycol; and, (iii) a $C_6$ to $C_{30}$ aliphatic hydrocarbyl monocarboxylic acid;

and, (C) at least one oil-soluble or oil-dispersible molybdenum dithiocarbamate compound as an additive in an amount providing the composition with from about 40 to about 500 ppm of molybdenum.

2. A composition as claimed in claim 1, wherein the functionalised polyolefin (B (i)) is functionalised with a succinic anhydride functional group.

3. A composition as claimed in claim 1, wherein the functionalised polyolefin (B (i)) is polyisobutylene succinic anhydride (PIBSA).

4. A composition as claimed in claim 1, wherein (B(ii)) is polyethylene glycol (PEG).

5. A composition as claimed in claim 1, wherein the $C_6$ to $C_{30}$ aliphatic hydrocarbyl monocarboxylic acid is oleic acid.

6. A method of lubricating a spark-ignited or compression-ignited internal combustion engine comprising lubricating the engine with a lubricating oil composition as claimed in claim 1.

* * * * *